US005303643A

United States Patent [19]

Fisher et al.

[11] Patent Number: 5,303,643

[45] Date of Patent: Apr. 19, 1994

[54] WASTE CONTAINER CRUSHER

[75] Inventors: Mark J. Fisher, Menomonee Falls; Edward T. Arters, Milwaukee, both of Wis.

[73] Assignee: Applied Power Inc., Butler, Wis.

[21] Appl. No.: 6,907

[22] Filed: Jan. 21, 1993

Related U.S. Application Data

[62] Division of Ser. No. 772,985, Oct. 7, 1991, abandoned.

[51] Int. Cl.[5] ..... B30B 15/16; B30B 9/02; B30B 1/32

[52] U.S. Cl. ..... 100/51; 100/50; 100/125; 100/902; 100/269 R

[58] Field of Search ..... 100/902, 125, 50, 51, 100/245, 242, 53, 99, 214, 246, 255, 269 R, 48, 104, 110, 240

[56] References Cited

U.S. PATENT DOCUMENTS

| | | | |
|---|---|---|---|
| 2,212,047 | 8/1940 | Ross | 100/902 |
| 2,551,886 | 5/1951 | Jones | 100/247 |
| 3,041,975 | 7/1962 | Atherton et al. | 103/50 |
| 3,079,856 | 3/1963 | Swartz | 100/902 |
| 3,302,556 | 2/1967 | Durbin | 100/214 |
| 3,859,912 | 1/1975 | Mühlbach | 100/257 |
| 3,922,962 | 12/1975 | Goldkuhle | 100/53 |
| 4,927,085 | 5/1990 | Oberg | 100/902 |
| 4,953,109 | 8/1990 | Bugis | 100/50 |
| 5,060,564 | 10/1991 | Buford et al. | 100/902 |
| 5,103,721 | 4/1992 | Chou et al. | 100/902 |
| 5,109,763 | 5/1992 | Morris et al. | 100/902 |
| 5,136,934 | 8/1992 | Darby, Jr. | 100/902 |
| 5,174,199 | 12/1992 | King et al. | 100/902 |

FOREIGN PATENT DOCUMENTS

| | | | |
|---|---|---|---|
| 2157077 | 6/1973 | France . | |
| 0139300 | 10/1981 | Japan | 100/214 |
| 911766 | 11/1962 | United Kingdom . | |
| 2026937 | 2/1980 | United Kingdom . | |

OTHER PUBLICATIONS

"Get Your Money's Worth With The Patented Oberg TM Oil Filter Press", of Oberg division, UMI, Inc., Everett, Wash. 98201, no data available.

"Why are our Auto & Truck Oil Filter Crushers the Best?", of Ameri-Can Crusher, Oceanside, Calif. 92056 no date available.

"The Impactor Oil Filter Crusher", of G. A. Morris Enterprises, Inc., Newbury Park, Calif. 91320, no date available.

"Main Squeeze Oil Filter Compactor" no date available.

"Eliminator Oil Filter Crusher", of Odyssey Manufacturing Inc., Holland, Mich. 49423, no date available.

*Primary Examiner*—Harvey C. Hornsby
*Assistant Examiner*—Reginald L. Alexander
*Attorney, Agent, or Firm*—Quarles & Brady

[57] ABSTRACT

A waste container crusher particularly adapted for crushing automotive type oil filters or other structurally rigid disposables containing hazardous waste has a housing with an open bottom which is closed off by an anvil plate. The anvil plate slideably receives three equiangularly spaced posts which are secured to a roof plate at the top of the housing, above the anvil plate. Nuts on the posts support the anvil plate below the roof plate, so that the anvil plate is suspended from the roof plate by the posts. The roof plate is secured to a hydraulic cylinder which produces a 10 ton driving force for a platen guided by the posts to crush a container placed on the anvil plate below the platen. In the anvil plate, four blind bores in a rectangular pattern in the top surface intersect a central blind bore extending from the bottom surface, and a smaller central through-bore provides communication between the lower central blind bore and the top of the anvil plate. In one embodiment, a pneumatic-hydraulic control circuit is provided in which the hydraulic cylinder is driven until an air powered hydraulic pump stalls. In an alternate embodiment, an electro-hydraulic control circuit drives the hydraulic cylinder according to a timed cycle.

7 Claims, 4 Drawing Sheets

FIG. 3
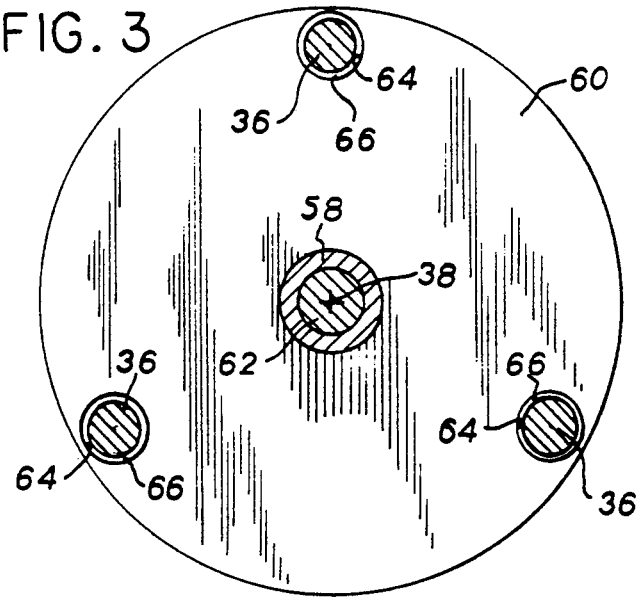
FIG. 5
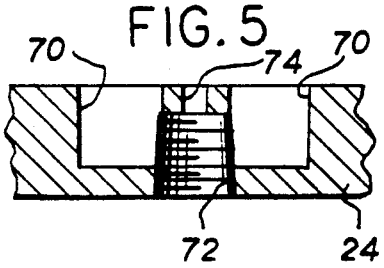
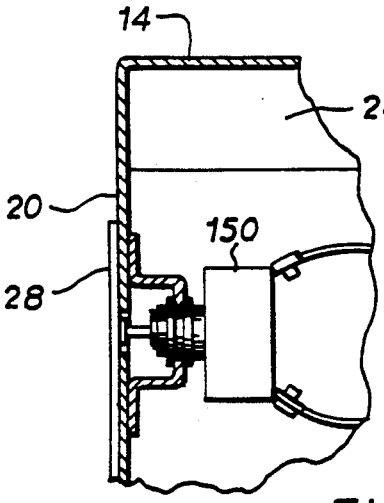
FIG. 9
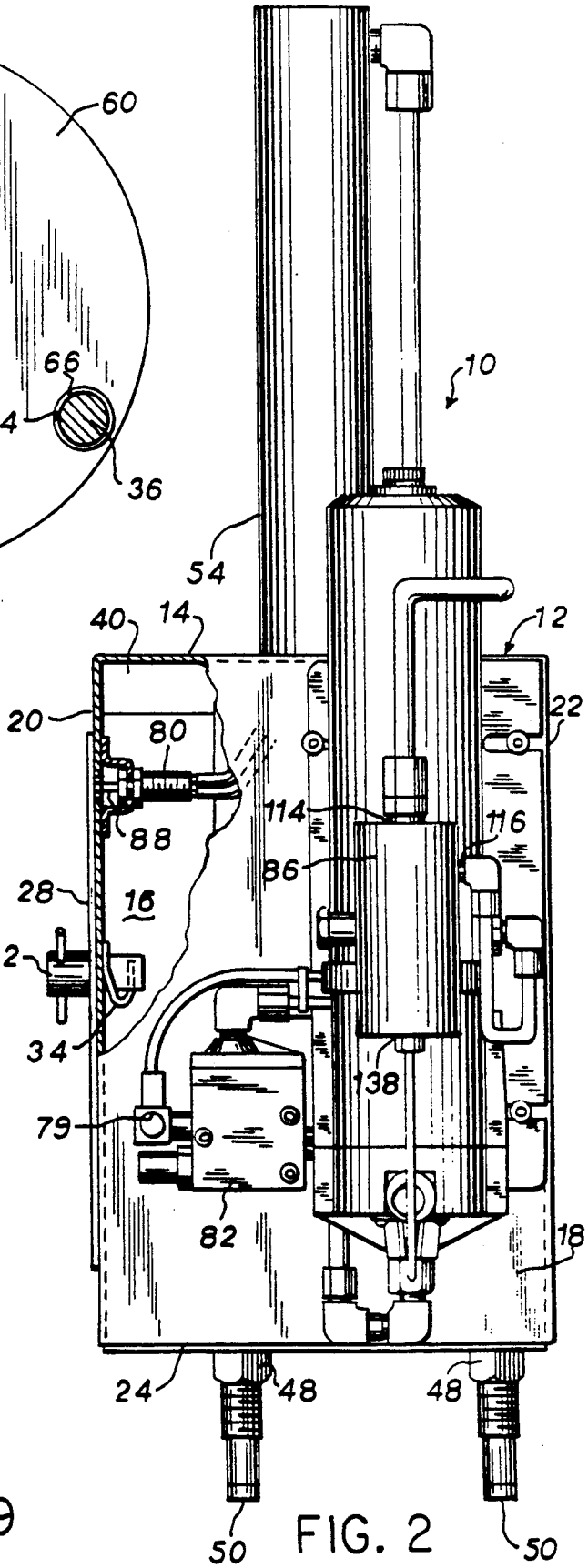
FIG. 2

WASTE CONTAINER CRUSHER

This is a division of application Ser. No. 07/772,985 filed Oct. 7, 1991, now abandoned.

FIELD OF THE INVENTION

This invention relates to devices for crushing waste containers in a manner to prepare them for recycling, and particularly to a device specially adapted for crushing disposable oil filters.

BACKGROUND OF THE INVENTION

Disposable oil filters, for example of the type commonly used on automotive engines, and other similar disposable items, have created a disposal problem. These items typically occupy a relatively large volume for the amount of solid materials which they contain and may contain an environmentally hazardous liquid, such as waste oil.

In some parts of the country, waste oil filters are now mandatorily recycled. However, whether oil filters are recycled or not, it is desirable to reduce their volume by collapsing or crushing them and to drain them of the majority of environmentally hazardous liquids which they contain.

To accomplish this purpose, a relatively large force is required to crush the oil filter axially. As is well known, oil filters of the automotive type are typically in the general shape of a cylindrical can. Crushing is usually accomplished by reducing the length of the can along the cylinder axis. For example, a four or five inch tall oil filter may typically be crushed to a height of one inch or less without appreciably changing the diameter of the filter. A large force is required because the diameter of the filter is typically about 3 to 4 inches and the filter is typically made of structurally rigid materials such as steel.

As a container such as an oil filter is crushed in this manner, the majority of liquid within the container is squeezed out. Therefore, a device for crushing such containers must be able to drain the liquids away from the container as the container is being crushed. These functions must be combined in a low cost, reliable and easy to use crusher.

SUMMARY OF THE INVENTION

The invention provides an improved waste container crusher particularly adapted for crushing automotive type oil filters or other structurally rigid disposables containing hazardous waste. The crusher has a roof plate, an anvil plate located a predetermined spacing below the roof plate, a housing enclosing the space between the roof and anvil plates. Each of a plurality of posts has one end secured in one of the plates and an opposite end slideably received in the other of the plates. The posts are angularly spaced apart about a longitudinal axis which is generally parallel to the posts. Means are provided on the slideably received ends of the posts for maintaining a predetermined spacing between the plates. A platen is slideably mounted on the posts for reciprocable movement along the longitudinal axis. Power means is fixed to the roof plate for driving the platen toward the anvil plate, and control means is provided for actuating the power means to crush a waste container placed on the anvil plate between the platen and the anvil plate when the recycler is operated.

In this construction, the posts guide the platen and also act as structural supports. The posts are placed in tension to bear substantially the entire load of the power means as the crusher is operated to crush a container. Since one end of each post is slideably received in one of the plates, the anvil plate is suspended from the roof plate so that it may realign itself under the roof plate as a container is being crushed. In this manner, undesirable side loading on the posts and the power means is substantially reduced in a compact, reliable and economical unit.

In a preferred form, the upper ends of the posts are secured in the roof plate and the lower ends of the posts are slideably received in the anvil plate. The housing is rigidly secured to one of the plates and not to the other plate. Thereby, distortions in the housing are prevented which may otherwise occur upon operating the crusher and the posts may also be used to support the roof plate over the anvil plate when the crusher is not in use.

In an especially useful form, three posts spaced 120° apart are provided. This allows a symmetrical load distribution on the platen to help prevent side loading on the power means, especially when a container is placed in the crusher not aligned with the longitudinal axis of the crusher.

In a preferred aspect, the anvil plate is provided with multiple holes which drain into a single hole. The multiple holes include a central hole substantially coaxial with the longitudinal axis and at least one hole offset from the longitudinal axis. In the most preferred form, four blind bores are formed in a top surface of the anvil plate in a generally rectangular pattern centered on the longitudinal axis, a central hole is formed in the top surface of the anvil plate substantially coaxial with the longitudinal axis, and a blind bore is formed in the bottom surface of the anvil plate which intersects the four holes and is in communication with the central hole.

In one form, the control means includes a compressed air powered hydraulic pump, an air interlock valve and the housing has a closeable door. The interlock valve is actuated by closure of the door to initiate operation of the air powered hydraulic pump, which is operated until it stalls. Thereby, a low cost and reliable non-electric control system is provided for operating the crusher.

In another form, the control means includes an electric powered hydraulic pump and an electric interlock switch. As in the pneumatic control system, the interlock switch is actuated by closure of the door to initiate operation of the electric powered hydraulic pump, which drives the platen to crush the container. However, this control system includes a timer for limiting the duration of the crushing stroke.

Other features and advantages of the invention will be apparent from the following detailed description and drawings.

BRIEF DESCRIPTION OF THE DRAWINGS

FIG. 2 is a right side elevation view of the crusher of FIG. 1 with a portion broken away;

FIG. 3 is a sectional view taken along the plane of the line 3—3 of FIG. 1;

FIG. 5 is a sectional view taken along the plane of the line 5—5 of FIG. 4;

FIG. 9 is a fragmentary view similar to FIG. 2 but for an electro-hydraulic powered alternate embodiment.

DETAILED DESCRIPTION OF THE PREFERRED EMBODIMENTS

Figure 1:
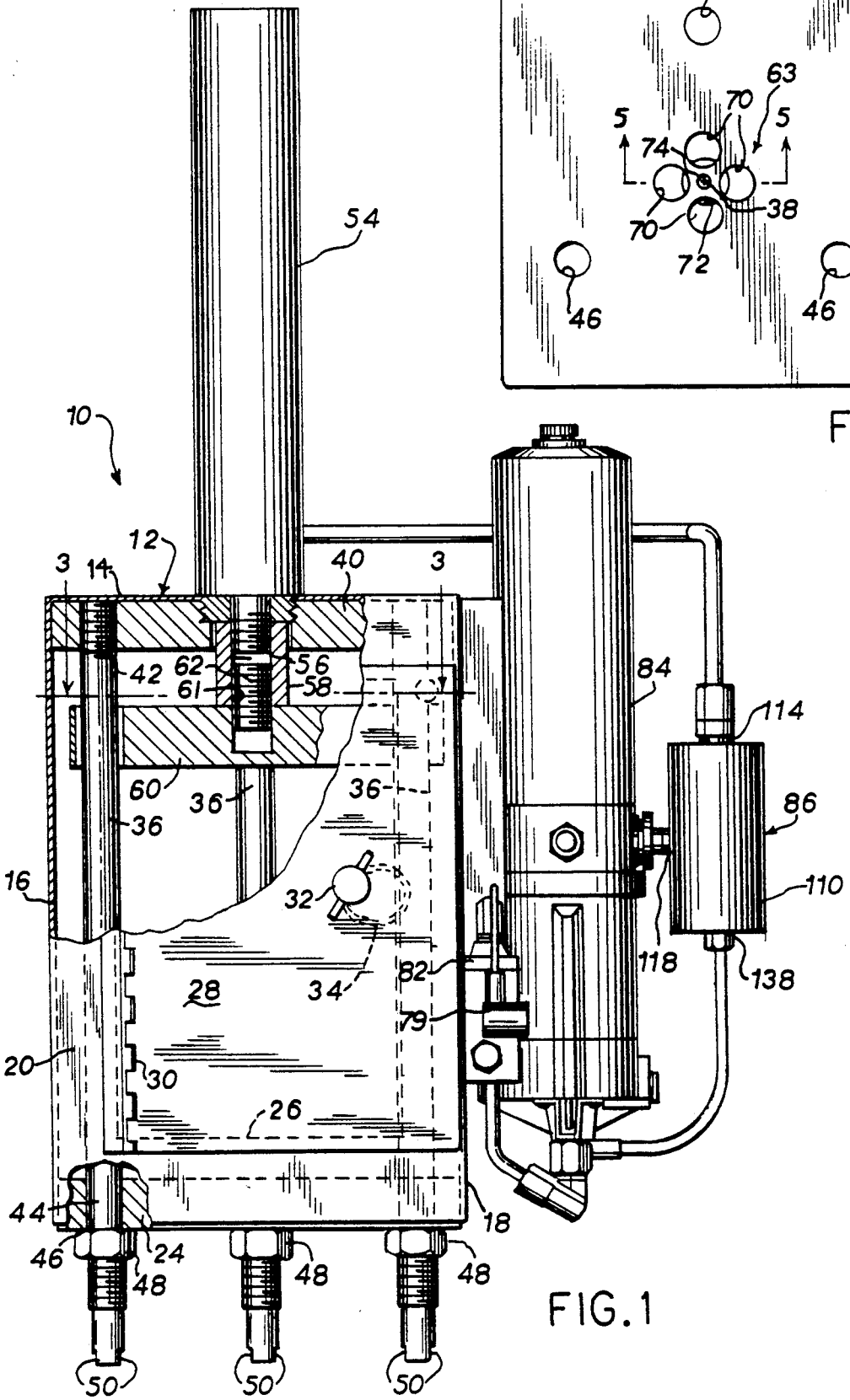
FIG. 1 is a front elevation view of a waste container crusher of the present invention with portions broken away.

Referring to FIGS. 1 and 2, a waste container crusher 10 of the present invention is illustrated. The waste container crusher 10 of the preferred embodiment is particularly adapted to crush oil filters of the automotive type. These filters are well known, are usually in the form of a cylindrical can which is about 3 to 6 inches tall as measured along its cylinder axis and usually about 3 to 5 inches in diameter.

The crusher 10 is usually used for crushing such containers along their cylindrical axis to effect a material decrease in length and corresponding increase in density of the container. For example, a 5 inch tall filter can be compressed to a height of approximately 1 inch or less. In this process, the great majority of oil inside the filter is squeezed out and drained away from the filter, as hereinafter described.

The crusher 10 includes a housing 12 made of relatively light gauge sheet metal and having a top 14, left side 16, right side 18, a front side 20 and a rear side 22. The bottom of the housing 12 is open but closed off by an anvil plate 24. The anvil plate 24 may be sealed with a suitable caulking material (not shown) to the housing 12 so as to prevent leakage, but otherwise is not directly secured to the housing 12.

The front side 20 of the housing 12 has an opening 26 which is covered in operation by a door 28. The door 28 is hinged at 30 to the front side 20 of the housing 12 and includes a latch 32. The latch 32 is rotatable and has a helical wire 34 which cams on the rear surface of the front side 20 to pull the door 28 tightly against the front side 20 when the latch 32 is rotated clockwise as viewed in FIG. 1.

Referring also to FIG. 3, three support posts 36 equiangularly spaced at 120° about a common center 38 support a roof plate 40 inside the housing 12 at the top of the housing 12. The housing 12 may be secured to the roof plate 40 by fasteners or other appropriate means (not shown).

Each of the posts 36 has a threaded top end 42 (only one shown) which is threaded into the roof plate 40 to secure the roof plate 40. Lower end 44 of each post 36 is slideably received within bores 46 of anvil plate 24. Below the anvil plate 24, the lower ends 44 are threaded and nuts 48 are received thereon which abut the bottom of the anvil plate 24 to support the anvil plate 24 at the bottom of the housing 12, spaced from the roof plate 40. The lower tips of the posts 36 have flats 50 to enable tightening the posts 36 to the roof plate 40 and for holding the posts 36 rotatably stationary when assembling the nuts 48.

The pattern of posts 36 is arranged to provide a large opening at the front of the housing 12 so that a container to be crushed can easily be placed upon the anvil plate 24. Also, it may be desirable to have the rear-most post 36 extend somewhat above the top of the housing 12 so that a suitable bracket can be attached to the top of the rear-most post 36 and also to the bottom for mounting the crusher 10 to a wall or other suitable vertical support.

The top 14 of the housing 12 has a central bore, as does the roof plate 40. The central bore of the roof plate 40 is threaded at 52 and a hydraulic cylinder 54 is threaded into it to be rigidly secured therein. The hydraulic cylinder 54 has a piston shaft 56 threaded into a coupling 58 which secures a platen 60 by means of a stud 62 which is threaded into the lower end of the coupling 58 and into the platen 60 at 61. The platen 60 is circular as shown in FIG. 3 and has three equiangular spaced through-bores 64 in which the posts 36 are received. The posts 36 are hard chrome plated and a bronze bearing 66 is received with a press fit within each of the through bores 64. The lumen of the bronze bearing 66 is coated with a lubricious material, such as a polytetraflouroethylene resin, to substantially reduce friction between the platen 60 and the posts 36. Bearings 66 found suitable are commercially available from Garlock Bearing, Inc. of Thorofarey, N.J. under the trade designation type D-U. A smooth sliding fit is thereby achieved between each post 36 and the corresponding bearing 66, so that the posts serve to guide the platen 60 as it reciprocates up and down. The posts 36 also prevent side loading on the cylinder 54 which may otherwise result if a container to be crushed is not concentrically aligned with the center 38 as it rests on the anvil plate 24.

The posts 36 serve not only to guide the platen 60 and prevent undesirable side loading on the piston shaft 56 and hydraulic cylinder 54, but also serve as structural supports for the crusher 10. The crusher 10, as previously described may be supported by hanging from the top of the rear-most post 36 and supporting the rear-most post 36 from the bottom, or may be supported from the bottom of the nuts 48, for example on a table top having holes through which the lower ends 44 of the posts 36 would extend so that the nuts 48 could rest on the table top. When the crusher 10 is not in use, the posts 36 serve to support the roof plate 40 and hydraulic cylinder 54 above the anvil plate 24, with the anvil plate 24 simply resting on top of the nuts 48. When in use, the force of the hydraulic cylinder 54, 10 tons in the preferred embodiment, acts to try to separate the anvil plate 24 from the roof plate 40. Therefore, when in use the posts 36 serve to support the spacing between the anvil plate 24 and roof plate 40 to prevent them from separating. Thereby, the 10 ton load exerted by the cylinder 54 is born by the three posts 36 acting under a tensile loading.

Figure 4:
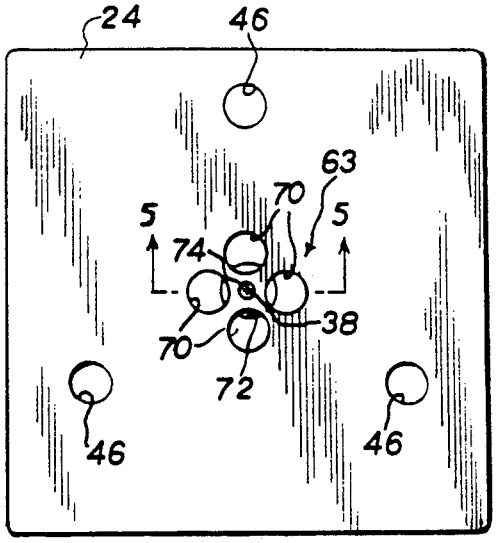
FIG. 4 is a top plan view of an anvil plate for the crusher of FIG. 1.

Referring to FIGS. 4 and 5, the anvil plate 24 is provided with a special arrangement 63 of holes to allow for the proper draining of an automotive type oil filter while the filter is being crushed. A rectangular pattern of four equiangularly spaced blind bores 70 is provided in the top surface of the anvil plate 24. A fitting hole 72 extends from the lower surface of the anvil plate 24 upwardly and is of a diameter to intersect the holes 70, thereby creating a path of communication from each hole 70 into the fitting hole 72. Fitting hole 72 does not extend all the way through the anvil plate 24 but a smaller central through-bore 72 is provided in the center of the holes 70 which extends from the top surface of the anvil plate 24 through to the fitting hole 72.

In use, an oil filter is placed with its open end down on top of the anvil plate 24. Typical oil filters have a relatively large central hole with a circular pattern of smaller holes spaced around the larger hole and with a ring of metal between the circular pattern of smaller holes and the larger central hole. The oil filter is placed on top of the anvil plate 24 with its larger central hole generally aligned with the central hole 74. Thereby, the central hole 74 and holes 70 provide passages for the escape of oil through the central hole of the filter as well as through the smaller peripheral holes. A central drain passage as well as peripheral drain passages are provided because the ring of metal between the circular pattern of smaller holes and the larger central hole of an oil filter can create a seal against the anvil plate 24 when the filter is being crushed. This arrangement of drain holes has been found to provide adequate draining while at the same time providing sufficient support against the forces generated in crushing an automotive type oil filter. The fitting hole 72 is tapped to receive a standard hose connection fitting so that the waste oil squeezed from the filter can be removed to an appropriate reservoir for subsequent disposal or further possessing.

A pneumatic-hydraulic control system 78 for the crusher 10 includes a port 79 for connection to a source of compressed air, an interlock valve 80, a main air valve 82, an air powered hydraulic pump 84, and a dump valve 86. The purpose of the control system is to automatically operate the hydraulic cylinder 54 to crush a container placed beneath the platen 60.

Figure 6:
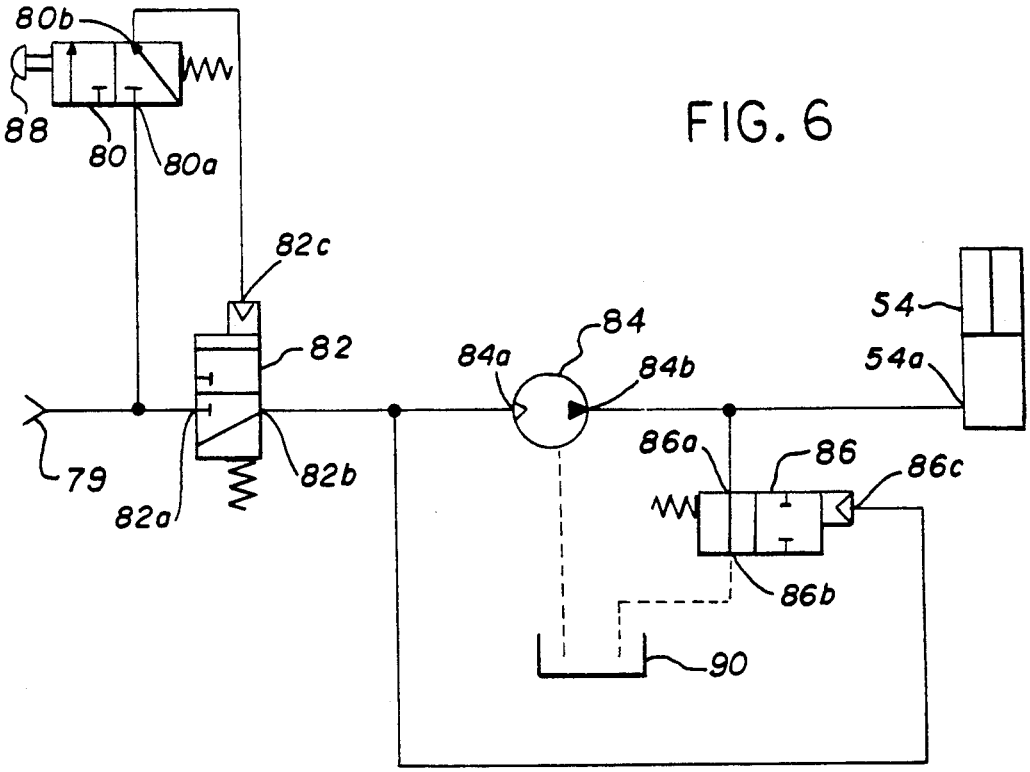
FIG. 6 is a schematic view of a pneumatic-hydraulic control circuit for the crusher of FIG. 1.

The interlock valve 80 is mounted on the rear surface of the front side 20 of the housing 12 and has a push type spring return actuator 88 which is depressed by the door 28 as the latch 32 is turned clockwise as viewed in FIG. 1. Also referring to FIG. 6, suitable pneumatic tubing connects a first port 80*a* of the interlock valve 80 to the air supply and a second port 80*b* to a pilot port 82*c* of a spring biased main air valve 82. When the interlock valve 80 is actuated, it is shifted against its spring force to shift the main air valve 82 against its spring force, which place the first and second control ports 82*a* and 82*b* of the valve 82 in communication. Since the main air valve 82 has control port 82*a* connected to the air supply and control port 82*b* connected to a pneumatic port 84*a* of the air powered hydraulic pump 84, pressurizing the valve 82 pilot port 82*c* provides air pressure from the air supply to drive the air powered hydraulic pump 84.

The air powered hydraulic pump 84 used in the preferred embodiment is capable of producing a hydraulic pressure of approximately 10,000 psi given an inlet air pressure of approximately 80 psi. Such pumps are well known and one such pump is described in U.S. Pat. No. 3,041,975 issued Jul. 3, 1962, the disclosure of which is hereby incorporated by reference. The pump described in U.S. Pat. No. 3,041,975 is a reciprocating type pump in which a relatively large surface area pneumatic piston drives a relatively small diameter hydraulic piston, and the pump includes a reservoir of hydraulic fluid. A suitable pump like that described in U.S. Pat. No. 3,041,975 is commercially available from Applied Power, Inc., Butler, Wis. under the trade designation PA-133. The valves 80 and 82, and cylinder 54 are also all well known commercially available items.

The hydraulic port 84*b* of the hydraulic pump 84 is routed to a port 54*a* of the hydraulic cylinder 54 and to a first control port 86*a* of the dump valve 86. The cylinder 54 has only one port because it is advanced under pressure and returned by a low force spring. In the preferred embodiment, the hydraulic cylinder 54 is capable of producing a 10 ton force given a 10,000 psi hydraulic pressure. Thereby, with an 80 psi air supply pressure, a force of 10 tons is produced for crushing waste containers in the crusher 10.

The dump valve 86 is for relieving pressure from the hydraulic cylinder 54 upon the completion of a crushing cycle. In addition to having a first control port 86*a* in communication with the hydraulic port of the pump 84, the hydraulic dump valve 86 has a pilot port 86*c* in communication with the pneumatic port 84*a* of the pump 84 and a second control port 86*b* connected to tank 90. Thus, when valve 82 is shifted so as to provide pneumatic pressure to the pump 84, the dump valve 86 is shifted so as to block the flow of hydraulic fluid from the pump 84 to tank 90, which may conveniently be provided in the pump 84 as hereinafter discussed. When the pilot pressure is exhausted from the dump valve 86, which is what happens when valve 82 shifts to its normal "off" position, the valve 86 returns to its normal position shown in FIG. 6 so that the cylinder 54 and the hydraulic port 84*b* of the pump 84 are vented to tank 90.

In operation of the waste container recycler 10, a waste container containing liquid is placed open end down generally centered on the hole 74. The door 28 is then shut and the latch 32 rotated clockwise as viewed in FIG. 1 to pull the door 28 tightly shut. This action actuates the interlock valve 80, which provides pilot pressure to the main air valve 82 to shift the main air valve 82 so as to provide supply pressure to the air powered hydraulic pump and pilot pressure to the dump valve 86. The hydraulic output of the pump 84 is thereby provided to the cylinder 54 to advance the piston shaft 56. This provides a 20,000 pound force on the waste container placed beneath the platen 60.

When the container has been crushed to the force limit of the cylinder 54, the output hydraulic pressure of the pump 84 reaches its capacity when the air pressure acting on the piston within the pump 84 is no longer able to overcome the hydraulic pressure which the pump has developed. When this occurs, the pump 84 stalls and holds the output pressure being exerted on the cylinder 54. Only when the door 28 is opened is the force exerted by the platen 60 on the container released. When the door 28 is opened, the interlock valve 80 is returned to the position shown in FIG. 6 by its return spring to vent the pilot pressure on the main air valve 82 to exhaust. This shifts the main air valve back to the position shown in FIG. 6 under the action of the main air valve return spring, which vents the pneumatic port of the pump 84 and the pilot pressure of the dump valve 86 to exhaust. Venting the dump valve 86 pilot pressure to exhaust opens up the pump 84 hydraulic output and the cylinder 54 pressure to tank 90, which allows the cylinder 54 to return the platen 60 to near the top of the housing 12 under the action of the cylinder return spring.

Figure 7:
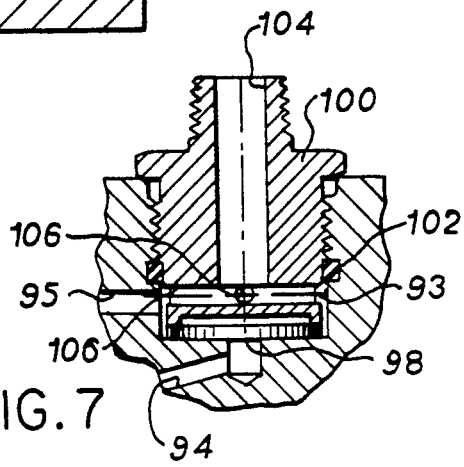
FIG. 7 is a sectional view of a modified porting arrangement for a pump for the pneumatic-hydraulic control circuit of FIG. 6.

It is noted that if a hydraulic pump 84 like the pump disclosed in U.S. Pat. No. 3,041,975 is used, it can be conveniently modified as shown in FIG. 7 to provide the connection of the dump valve 86 back to tank. In this regard, in FIG. 7, the reference numerals 93, 94 and 95 refer to the same items as in FIGS. 7 and 8 of U.S.

Pat. No. 3,041,975, namely, bore 93, release passage 94 which is in communication with the hydraulic output of pump 84, and release passage 95 which is in communication with the reservoir tank of pump 84.

Referring to FIG. 7, in the preferred modification, the components occupying bore 93 described in U.S. Pat. No. 3,041,975 are replaced with a plug disk 98 and a nipple 100. The interface between passage 94 and bore 93 is sealed off by plug disk 98, which is held in place with nipple 100. Nipple 100 is threaded into the bore 93 and sealed therein by O-ring 102. Nipple 100 has an axial bore 104 in communication with one or more transverse bores 106. Thereby, axial bore 104 communicates with the tank of the pump 84 via bores 106 and passage 95.

Figure 8:
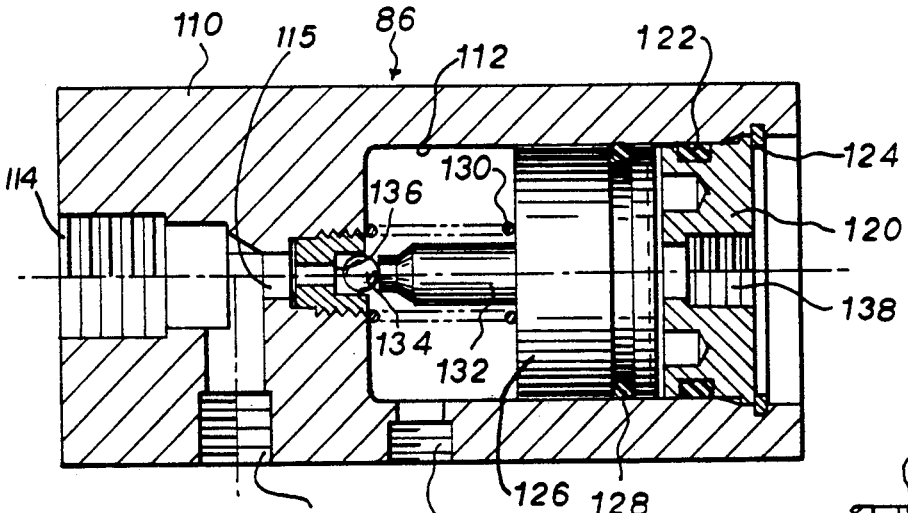
FIG. 8 is a sectional view of a dump valve for the pneumatic-hydraulic control circuit of FIG. 6.

FIG. 8 depicts a preferred form of dump valve 86. The dump valve 86 has a valve block 110 in which a pilot cavity 112 and passageways 114, 116 and 118 are formed. In FIG. 8, the passageway 118 is shown rotated into a plane which is 90° from its actual position for illustrative purposes. Passageway 114 is connected to the port **54*a* of cylinder 54, passageway 116 is connected to the hydraulic port 84*b* of the pump 84, and passageway 118, which corresponds to port 86*b*, is connected to the nipple 100 to be in communication with axial bore 104, so that passageway 118 is in communication with the reservoir tank of the pump 84. Passageway 115, which corresponds to port 86*a*, opens into the intersection of passageways 114 and 116. A plug 120 is provided in the valve block 110, is sealed therein with an O-ring seal 122 and is held in place by a spring clip 124**.

A piston 126 is sealed against the pilot cavity 112 by an O-ring 128 and held biased against the plug 120 by spring 130. Pin 132 projects from piston 126 and normally holds ball 134 against a seat 136 when the pilot cavity 112 is pressurized. In this regard, the plug 120 has a central threaded hole 138, which corresponds to port **86*c*, which is for connection to communicate with the pneumatic port 84*a* of the pump 84. The face of piston 126 is sized such that at 80 psi air pressure in the pilot cavity 112, sufficient force will be generated to hold the ball 134 against hardened seat 136 at 10,000 psi hydraulic pressure in passageway 116**.

Figure 10:
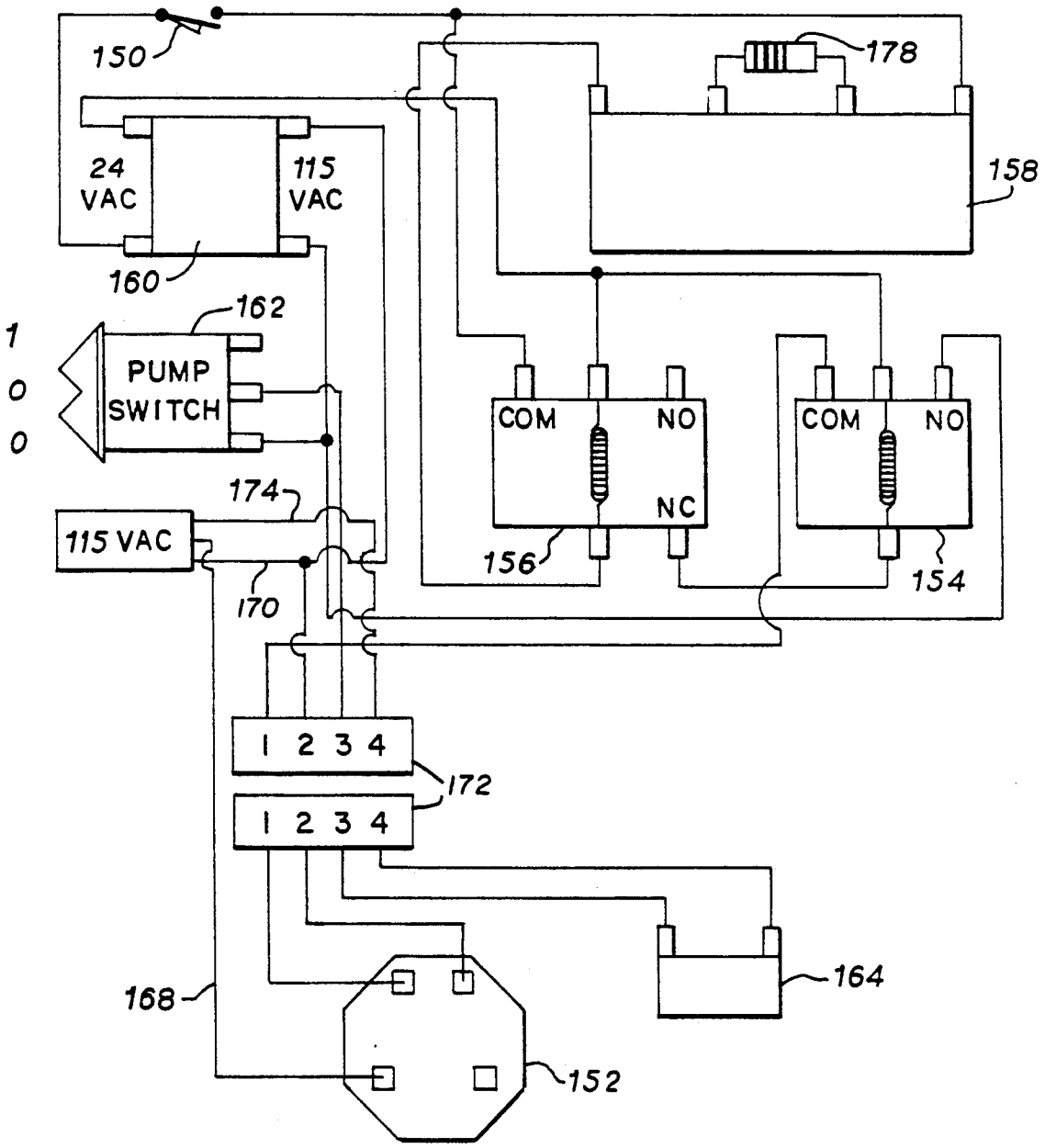
FIG. 10 is a schematic view of a control circuit for the electro-hydraulic embodiment.

Referring to FIGS. 9 and 10, a electro-hydraulic control system 148 for a crusher of the invention is disclosed as an alternate to the pneumatic-hydraulic control system 78. Referring to FIG. 9, the interlock valve 80 is replaced with an interlock switch 150. In addition, the main air valve 82, air powered hydraulic pump 84, and the dump valve 86 are replaced by the electrohydraulic control system 148. The control system 148 is powered by 115 volts AC power and has an electric powered hydraulic pump 152, a first relay 154, a second relay 156, a timer 158, a transformer 160, a switch 162 and a thermal switch 164, all of which are well-known commercially available components.

From source 166, ground lead 168 is connected to motor 152. Power lead 170 is connected to one terminal of the 115 volt side of transformer 160 and, via plug 172, to one of the power terminals of the pump 152. Power lead 174 is connected via plug 172 to one terminal of thermal switch 164, which is normally closed and provided for thermal protection of the pump 152. The other terminal of thermal switch 164 is connected via plug 172 to the common terminal of pump switch 162 and the normally off terminal of switch 162 is connected to the other terminal on the 115 volt side of the transformer 160 and to a normally open terminal on the first relay 154. The common terminal on the first relay 154 is connected via plug 172 to the other power terminal of the pump 152.

The transformer 160 steps down the 115 volts AC to 24 volts AC. One of the 24 volt terminals of transformer 160 is connected to interlock switch 150, which is normally open, and the other terminal of the switch 150 is connected to the input terminal of timer 158 and to the common terminal of the second relay 156. The timer 158 is a solid state timer, commercially available from Artisan Industries of Parsippaney, New Jersey, Part No. 438U. The timer 158 has a resistor 178, the value of which determines the timing period. The timing period begins when the timer 158 senses a signal at its input terminal, and at the end of the timing period the signal is passed through to the timer 158 output terminal, which is connected to one side of the coil for the second relay 156. The other side of the coil of the second relay 156 is connected to the other power terminal on the 24 volt side of the transformer 160, which is also connected to one side of the coil of the first relay 154. The other side of the coil of the first relay 154 is connected to the normally closed terminal of the second relay 156.

In operation, the pump switch is turned on, but this does not initiate the beginning of a crushing cycle. First, a filter is placed beneath the platen 60, with its open end down as previously described. Then, the door 28 is closed as previously described, which actuates interlock switch 150. Assuming that the thermal switch 164 has not been actuated, when the interlock switch 150 is closed, the first relay 154 is energized and timing by timer 158 begins. Energizing relay 154 starts pump 152 which provides hydraulic fluid under pressure to drive hydraulic cylinder 54.

For the duration of the timing period, typically 30 seconds, the platen 60 is driven downwardly by hydraulic cylinder 54 to crush the container placed beneath the platen 60. When the timer 158 times out, second relay 156 is energized which de-energizes the first relay 154. This turns the pump 152 off, which has the effect of depressurizing the hydraulic cylinder 54 so that the platen 60 lifts under the influence of the return spring of the hydraulic cylinder 54. A new cycle cannot be initiated until the door 28 is opened. When the door 28 is opened, interlock switch 150 opens, which turns off power to the timer 158 to reset the control circuit to be ready for the initiation of the next crushing cycle.

Preferred embodiments of the invention have been described. Many modifications and variations of the preferred embodiments will be apparent to those of ordinary skill in the art, but which will still be within the spirit and scope of the invention. Therefore, the invention should not be limited by the scope of the preceding description of the preferred embodiments, but only by the claims which follow.

We claim:

1. A waste container crusher, comprising:

a housing having a closeable door;

an anvil plate for supporting a container to be crushed within said housing;

a platen for crushing said container against said anvil plate;

a hydraulic cylinder for driving said platen against a container to be crushed supported on said anvil plate within said housing, said cylinder having a cylinder port;

an air powered hydraulic pump having a pneumatic port and a hydraulic port, said pump providing a supply of hydraulic fluid at said hydraulic port which can be compressed to a pressure limit which is proportional to a pressure of a compressed air supply provided at said pneumatic port;

a main air valve having a first port and a second port, said valve blocking said first port and venting said second port in an off state and connecting said first and second ports in an on state;

means communicating said hydraulic port and said cylinder port;

means communicating said second port of said main air valve and said pneumatic port;

means for providing a supply of compressed air at a certain pneumatic pressure to said first port of said main air valve; and means for changing said main air valve between said on and off states including an interlock control actuated by closing said door such that said main air valve is turned on when said door is closed and is turned off when said door is opened;

wherein when said door is closed, said pump drives said cylinder to said pressure limit, whereat said pump stalls, and said pump maintains the pressure of said cylinder at said pressure limit after said pump stalls until said door is opened.

2. A waste container crusher as in claim 1, wherein said interlock control is a pneumatic valve which is shifted upon closing said door to pressurize a pilot port of said main air valve to thereby turn said main air valve on.

3. A waste container crusher as in claim 1, further comprising a pneumatically actuated dump valve in communication with said pump hydraulic port so as to vent said pump hydraulic port to a reservoir tank when said door is opened.

4. A waste container crusher as in claim 1, wherein said air powered hydraulic pump is a reciprocating pump.

5. A waste container crusher as in claim 1, further comprising:

a dump valve, said dump valve having a first port, a second port and a pneumatic pilot port;

a reservoir tank of hydraulic fluid;

means communicating said dump valve first port and said cylinder port;

means communicating said dump valve second port and said reservoir tank;

means communicating said dump valve pneumatic pilot port and said pump pneumatic port;

wherein in the on state of said main air valve said dump valve first and second ports are blocked and in the off state of said main air valve said dump valve first and second ports are placed in communication.

6. A waste container crusher, comprising:

a housing having a closeable door;

an anvil plate for supporting a container to be crushed within said housing;

a platen for crushing said container against said anvil plate;

a hydraulic cylinder for driving said platen against a container to be crushed supported on said anvil plate within said housing, said cylinder having a cylinder port;

an air powered hydraulic pump having a pneumatic port and a hydraulic port, said pump providing a supply of hydraulic fluid at said hydraulic port which can be compressed to a pressure limit which is proportional to a pressure of a compressed air supply provided at said pneumatic port;

a main air valve having a first port and a second port, said valve blocking said first port and venting said second port in an off state and connecting said first and second ports in an on state;

means communicating said hydraulic port and said cylinder port;

means communicating said second port of said main air valve and said pneumatic port;

means for providing a supply of compressed air at a certain pneumatic pressure to said first port of said main air valve;

means for changing said main air valve between said on and off states including an interlock control actuated by closing said door such that said main air valve is turned on when said door is closed and is turned off when said door is opened;

wherein when said door is closed, said pump drives said cylinder to said pressure limit, whereat said pump stalls;

a dump valve, said dump valve having a first port, a second port and a pneumatic pilot port;

a reservoir tank of hydraulic fluid;

means communicating said dump valve first port and said cylinder port;

means communicating said dump valve second port and said reservoir tank;

means communicating said dump valve pneumatic pilot port and said pump pneumatic port;

wherein in the on state of said main air valve said dump valve first and second ports are blocked and in the off state of said main air valve said dump valve first and second ports are placed in communication;

wherein said means for changing said main air valve between said on and off states includes a main air valve pneumatic pilot port of said main air valve, and wherein said interlock control includes an interlock valve which is actuated by closing said door, said interlock valve having a first port and a second port, said first and second ports being placed in communication by closing said door and said first port being normally blocked and said second port being normally vented in the open position of said door;

means connecting said main air valve pilot port and said interlock valve second port; and means for providing compressed air to said main air valve first port and said interlock valve first port;

wherein closing said door actuates said interlock valve to change said main air valve to said on state and opening said door deactuates said interlock valve to return said main air valve to said off state.

7. A waste container crusher, comprising:

an anvil plate for supporting a container to be crushed;

a platen for crushing said container against said anvil plate;

a hydraulic cylinder for driving said platen against a container to be crushed supported on said anvil plate, said cylinder having a cylinder port;

an air powered hydraulic pump having a pneumatic port and a hydraulic port, said pump providing a supply of hydraulic fluid at said hydraulic port which can be compressed to a pressure limit which is proportional to a pressure of a compressed air supply provided at said pneumatic port;

a main air valve having a first port, a second port and a pilot port, said valve being normally biased to block said first port and vent said second port in an off state and being shiftable against said bias when said pilot port is pressurized to connect said first and second ports in an on state;

a dump valve having a first hydraulic port, a second hydraulic port and a pneumatic pilot port, said dump valve being normally biased to provide communication between said first hydraulic port and said second hydraulic port and to cut off said communication when said pneumatic pilot port is pressurized;

a reservoir tank of hydraulic fluid;

means communicating said hydraulic port, said cylinder port and said first hydraulic port of said dump valve with one another;

means communicating said second port of said main air valve, said pneumatic port and said pilot port of said dump valve;

means communicating said second hydraulic port of said dump valve and said reservoir tank with one another;

an interlock valve having a first port, a second port and an actuator, said interlock valve being normally biased to block said first port and vent said second port and being shiftable by said actuator against said bias to communicate said first and second ports with one another;

means for providing compressed air to said first ports of said main air valve and said interlock valve;

means providing communication between said second port of said interlock valve and said pilot port of said main air valve; and a housing for enclosing said container when said container is being crushed, said housing having a door which when closed actuates said actuator of said interlock valve;

wherein closing said door shifts said interlock valve to pressurize said pilot port of said main air valve to shift said main air valve to pressurize the pneumatic port of said pump and the pilot port of said dump valve to drive said pump and close said dump valve until the first to occur of either said pump stalling or said door opening.

* * * * *